US007556085B2

(12) United States Patent
Childs et al.

(10) Patent No.: US 7,556,085 B2
(45) Date of Patent: Jul. 7, 2009

(54) REVERSIBLE HEAT TRANSFER ELEMENT BASKET ASSEMBLY WITH INTEGRATED FRAME FOR USE IN A HEAT EXCHANGER

(75) Inventors: Cary J. Childs, Wellsville, NY (US); Lawrence G. Cowburn, Ulysses, PA (US); Jeffrey W. Gaylor, Little Genesee, NY (US); Mark M. Gibble, Shinglehouse, PA (US); Timothy R. Gustin, Wellsville, NY (US); David A. Pye, Wellsville, NY (US); Dean L. Rhodes, Portville, NY (US)

(73) Assignee: ALSTOM Technology Ltd, Baden (CH)

( * ) Notice: Subject to any disclaimer, the term of this patent is extended or adjusted under 35 U.S.C. 154(b) by 0 days.

(21) Appl. No.: 11/732,170

(22) Filed: Apr. 3, 2007

(65) Prior Publication Data

US 2008/0245500 A1 Oct. 9, 2008

(51) Int. Cl.
*F23L 15/02* (2006.01)

(52) U.S. Cl. ..... 165/8; 165/4; 165/10

(58) Field of Classification Search ..... 165/4, 165/6, 8, 10
See application file for complete search history.

(56) References Cited

U.S. PATENT DOCUMENTS 4,209,060 A * 6/1980 Wiking et al. ..... 165/8
4,739,822 A 4/1988 Mergler
4,789,024 A * 12/1988 Muscato ..... 165/8
4,984,621 A 1/1991 Miller et al.
5,119,885 A 6/1992 Johnson
5,664,621 A * 9/1997 Brophy ..... 165/4
5,740,856 A * 4/1998 Ritter ..... 165/8
5,893,406 A * 4/1999 Brophy ..... 165/6
5,913,359 A * 6/1999 Milligan et al. ..... 165/9

OTHER PUBLICATIONS

PCT International Search Report and The Written Opinion of the International Searching Authority dated May 8, 2008—(PCT/US2008/059220).

* cited by examiner

*Primary Examiner*—Ljiljana (Lil) V Ciric
(74) *Attorney, Agent, or Firm*—Timothy J. Olson

(57) ABSTRACT

A heat exchanger heat transfer element basket assembly (500) for receiving heat transfer element plates (850) therein. The heat exchanger heat transfer element basket assembly (500) includes first and second one-piece side straps (520*a*, 520*b*), a pair of inboard corner flanges (528*a*, 528*b*), an I-shaped splitter plate (530), a pair of outboard corner flanges (522*a*, 522*b*), first and second end straps (526*a*, 526*b*), and a cap. Each of the first and second one-piece side straps (520*a*, 520*b*) includes a center portion (625), a first extension (630), and a second extension (635). Each of the first and second extensions (630, 635) includes a flange portion that is folded over across the heat transfer element plates (850) so as to be operative to retain the heat transfer element plates (850) in the heat exchanger heat transfer element basket assembly (500).

19 Claims, 8 Drawing Sheets

REVERSIBLE HEAT TRANSFER ELEMENT BASKET ASSEMBLY WITH INTEGRATED FRAME FOR USE IN A HEAT EXCHANGER

FIELD OF THE INVENTION

The present invention relates to a rotary regenerative heat exchanger, and more particularly, to an improved low profile heat transfer element basket assembly for use in such a heat exchanger.

BACKGROUND OF THE INVENTION

The present invention has particular application in a heat transfer apparatus in which the heat transfer element, also called a sheet or plate, is heated by contact with a hot gaseous heat exchange fluid and is thereafter brought in contact with preferably a cool gaseous heat exchange fluid to which the heat transfer element gives up the heat that the heat transfer element has received by virtue of the heat transfer element's contact with the aforementioned hot gaseous heat exchange fluid.

One type of such heat exchange apparatus, which is commonly found in use, is that which those in the industry refer to as a rotary regenerative heat exchanger. Typically, such a rotary regenerative heat exchanger includes a cylindrical rotor that is divided into compartments and in each of which there are disposed a plurality of heat transfer plates which, as the aforementioned cylindrical rotor turns, are alternately exposed to a stream of a hot gaseous heat exchange fluid and then said cylindrical rotor is rotated whereupon the plurality of heat exchange plates become exposed to a stream of a cool gaseous heat exchange fluid that is to be heated. The compartments into which the cylindrical rotor of the heat exchanger is divided typically each house a plurality of heat transfer element basket assemblies that are suitably mounted therein and normally each embody a pie-shaped configuration. Each of the heat transfer element basket assemblies is designed to receive therein in supported relation thereto a plurality of heat transfer plates (e.g., sheets or elements). Each of these plurality of heat transfer plates when exposed to a hot gaseous heat exchange fluid absorbs heat therefrom, and then when each of these plurality of heat transfer plates is exposed to a cool gaseous heat exchange fluid, which is to be heated, transfers to the cool gaseous heat exchange fluid the heat that has been absorbed from the hot gaseous heat exchange fluid by each of the plurality of heat exchange plates.

Typically, such a prior art form of heat transfer element basket assembly comprises a pair of spaced end plates, which are held together by paired side straps that are designed to interconnect the end plates of the prior art form of heat transfer element basket assembly along the sides of the prior art form of heat transfer element basket assembly, such as, in the manner described and shown in U.S. Pat. Nos. 3,314,472 and 4,606,400. In accordance with the prior art teachings of U.S. Pat. Nos. 3,314,472 and 4,606,400 a plurality of heat transfer plates are stacked in closely spaced relationship within the housing of the prior art form of heat transfer element basket assembly in order to thereby provide a plurality of passageways between adjacent ones of the heat transfer plates such that heat exchange fluids may pass therethrough. Furthermore, in accordance with such prior art teachings, side straps are made to interconnect the spaced end plates of the prior art form of heat transfer element basket assembly in such a manner so as to extend in pairs along the opposite sides of the stacked array of heat exchange elements. With further regard to such prior art teachings, on each side of the heat exchange element there is provided a first side strap, which extends between the upper regions of the spaced end plates of the prior art form of heat transfer element basket assembly and a second side strap, which extends between the lower region of the spaced end plates of the prior art form of heat transfer element basket assembly in spaced, parallel relationship to the aforementioned first side strap. These side straps may be flanged inwardly along the longitudinal edge lying at the edge of the prior art form of heat transfer element basket assembly so as to thereby provide a retaining surface that is designed to be operative for purposes of preventing the heat transfer plates from falling out of the open ends of the prior art form of heat transfer element basket assembly, as shown, by way of exemplification, in U.S. Pat. No. 3,314,472. Typically, in accordance with prior art teachings one or more such retaining bars are welded between the end plates of the prior art form of heat transfer element basket assembly across the top and bottom ends thereof so as to thereby further assist in keeping the heat transfer element plates from falling out of the open ends of such a prior art form of heat transfer element basket assembly.

Although such prior art forms of heat transfer element basket assemblies are still commonly found in use, such prior art forms of heat transfer element basket assemblies are typically subject to rotational torsion of the side straps that are utilized therein as well as to lateral deformation due to the bowing of such side straps, which are employed therein to interconnect the spaced end plates thereof. U.S. Pat. No. 4,739,822 to Mergler, which is entitled "Low Profile Element Basket Assembly For Heat Exchanger," and which is assigned to the same assignee as the present invention, and which is incorporated herein in its entirety, is directed to an invention that is designed to address such rotational torsion and lateral deformation from which such prior art forms of heat transfer element basket assemblies have been found to suffer. While the invention to which U.S. Pat. No. 4,739,822 is directed has been found to be able to attain its stated goals, improvements to the heat transfer element basket assembly, which is described and illustrated in U.S. Pat. No. 4,739,822 are deemed to be still possible to be made.

Illustrated in FIGS. 1 and 2 of the present patent application is the heat transfer element basket assembly 130 of U.S. Pat. No. 4,739,822. This heat transfer element basket assembly 130 is comprised of a plurality of heat transfer element plates 132, which are arranged in a stacked array so as to thereby provide a plurality of flow passages located between adjacent ones of the heat transfer element plates 132. This stacked array of heat transfer element plates 132 is suitably arranged so as to be disposed between a first end plate 134 located at one end of the heat transfer element basket assembly 130 and a second end plate 136 located at the other end of the heat transfer element basket assembly 130. These end plates 134 and 136 are suitably positioned so as to abut the ends of the stacked array of heat transfer element plates 132 and are held in position there by means of side straps 140, 142 and 150, 152. These side straps 140, 142 and 150, 152 are disposed along opposite sides of the stacked array of heat transfer element plates 132 so as to thereby be positioned at the upper and lower edges, respectively, of the heat transfer element plates 132, whereby the side straps 140, 142 and 150, 152 are operative to effect an interconnection of the t first end plate 134 with the second end plate 136, the first end plate 134 and the second end plate 136 being spaced apart from one another.

Continuing with the description of the heat transfer element basket assembly 130 of U.S. Pat. No. 4,739,822, the side plates 140 and 142, as described and illustrated in U.S. Pat.

No. 4,739,822 are each welded at one end to the upper right corner and to the upper left corner, respectively, of the end plate 134 and in addition are also each welded at their other end to the upper right corner and to the upper left corner, respectively, of the end plate 136, which is located at the opposite end of the heat transfer element basket assembly from where the end plate 134 is located. In a similar manner, the side plates 150 and 152, as described and illustrated in U.S. Pat. No. 4,739,822, are each welded at one end to the lower right corner and to the lower left corner, respectively, of the end plate 134 and in addition are also each welded at their other end to the lower right corner and to the lower left corner, respectively, of the end plate 136, which is located at the opposite end of the heat transfer element basket assembly from where the end plate 134 is located.

With further reference thereto, the side straps 140, 142, 150 and 152 of the heat transfer element basket assembly 130 are, as described and illustrated in U.S. Pat. No. 4,739,822, flanged along their respective longitudinal edges that extend in juxtaposed relation to the upper and lower edges, respectively, of the heat transfer element basket assembly 130. To this end, the side straps 140 and 142 are provided with the flanges 141 and 143, respectively. These flanges 141 and 143 extend inwardly from the inside longitudinal edges of the side straps 140 and 142, respectively, so as to be located adjacent to the upper edges of the heat transfer element plates 132. In a similar manner, the side straps 150 and 152 are provided with the flanges 151 and 153, respectively. These flanges 151 and 153 extend inwardly from the inside longitudinal edges of the side straps 150 and 152, respectively, so as to be located adjacent to the lower edges of the heat transfer element plates 132. These upper flanges 141 and 143 and these lower flanges 151 and 153 function to provide retaining surfaces along the upper and lower edges of the heat transfer element basket assembly 130, which are designed to be operative to prevent the heat transfer element plates 132, which are stacked within the heat transfer element basket assembly from falling out of the open ends of the heat transfer element basket assembly 130 during the transportation thereof, or the handling thereof, or the installation thereof. In addition to these upper flanges 141 and 143 and these lower flanges 151 and 153, retaining bars 138 are typically also tack-welded between the end plates 134 and 136 at the open top and bottom of the heat transfer element basket assembly 130 intermediate the side straps 140, 142 and 150, 152 in order to thereby further assist in preventing the heat transfer element plates 132, which are stacked within the heat transfer element basket assembly 130, from falling out of the open ends of the heat transfer element basket assembly 130.

In accordance with the invention to which U.S. Pat. No. 4,739,822 is directed, a stiffening member 160 is disposed intermediate, that is, preferably midway between and parallel to the spaced end plates 134 and 136 of the heat transfer element basket assembly 130. This stiffening member 160 is suitably positioned therewithin so as to extend transversely across the heat transfer element basket assembly 130. Furthermore, this stiffening member 160, as described and illustrated in U.S. Pat. No. 4,739,822, is welded at the lateral edges thereof to the side straps 140, 142, 150 and 152 to which reference has been had hereinbefore in order to thereby structurally interconnect the side straps 140, 142 and 150, 152 at a point that is near the mid-span of heat transfer element basket assembly 130 so as to thereby increase the structural integrity of the frame of the element basket assembly 130.

With further reference to the stiffening member 160, as best understood with reference to FIG. 2*a* of the present patent application, the stiffening member 160 may comprise a single plate 175, which is similar in nature to the end plates 132 and 134 previously described herein, which extend from the top to the bottom and from side to side across the entire cross-sectional area of the heat transfer element basket assembly 130 at the respective opposite ends thereof. Continuing with the description thereof, the single stiffening member 175, in accordance with the teachings of U.S. Pat. No. 4,739,822, is welded at each of the lateral edges thereof to each of the upper side straps 140 and 142 and lower side straps 150 and 152 as best understood with FIG. 2 of the drawings in order to thereby structurally interconnect all of the side straps 140, 142, 150 and 152 with one another.

Alternatively, as best understood with reference to FIG. 2*b* of the present patent application, the stiffening member 160 may comprise a pair of spaced elongated plank-like dual members 170*a* and 170*b*, which are suitably positioned so as to extend across the upper region of the heat transfer element basket assembly 130 and across the lower region of the heat transfer element basket assembly 130, respectively. With further reference thereto, the member 170*a* is welded at the lateral edges thereof to the upper side straps 140 and 142, whereas the member 170*b* is welded at the lateral edges thereof to the lower side straps 150 and 152.

Continuing herein with the description thereof, both the single stiffing member 175 and the dual stiffening members 170*a* and 170*b* are designed to be operative to provide a cross-link that is suitable for interconnecting the upper side straps 140 and 142 with one another and that is also suitable for interconnecting the lower side straps 150 and 152 with one another, at or near the mid-span of the heat transfer element basket assembly 130 between the spaced end plates 132 and 134 of the heat transfer element basket assembly 130 in order to thereby increase the structural integrity of the frame of the heat transfer element basket assembly 130. As a consequence thereof, not only is the weight capacity of the heat transfer element basket assembly 130 increased, but also in addition the rotational torsion of the side straps 140, 142 and 150, 152 as well as the lateral deformation of the frame of the heat transfer element basket assembly 130 are also effectively prevented. Although not shown in FIG. 2*a* of the present patent application, the single stiffening member 175 is capable in addition of being utilized as a means of effecting therewith the lifting of the heat transfer element basket assembly 130.

The heat transfer element basket assembly 130 as described and illustrated in U.S. Pat. No. 4,739,822 has been found to require an extensive amount of time to fabricate due to the amount of hand welding required thereby. To this end, the use of four separate side straps 140, 142, 150, and 152 and two separate end plates 134 and 136 requires that the heat transfer element basket assembly 130 be completely welded by hand during fabrication. Further to this point, such hand welding during fabrication requires not only that there be extra time allotted for purposes of effecting the fit up of the welding fixtures that are needed to accomplish the hand welding, but in addition extra personnel are also required for this purpose, which in turn not only is expensive, but also introduces the possibility of there being quality assurance issues associated therewith. It has been found that such extra time can cause delays in the assembly line process, which is employed for purposes of effecting therewith the fabrication of the heat transfer element basket assembly 130. Accordingly, a need has been found to exist for a heat transfer element basket assembly that for purposes of the fabrication thereof can be assembled without hand welding being required.

Additionally, an excessive amount of material is used in fabricating the single stiffening member 160, dual stiffening member 170*a* and 170*b*, and end plates 134 and 136 of the heat transfer element basket assembly 130, which is described and illustrated in U.S. Pat. No. 4,739,822. Furthermore, the size and shape of the stiffening member 160, 170*a*, and 170*b* and end plates 134 and 136 that are employed in the heat transfer element basket assembly 130, which is described and illustrated in U.S. Pat. No. 4,739,822, require that they be welded during the fabrication process. As such, this results in scrap material being produced as well as in adding cost to the fabrication of the heat transfer element basket assembly 130. Accordingly, a need has also been found to exist for a heat transfer element basket assembly that does not result in excessive material being required for the fabrication thereof.

Another disadvantage that is associated with the heat transfer element basket assembly 130, which is described and illustrated in U.S. Pat. No. 4,739,822, is that the flanges 141, 143, 151, and 153 on the side straps 140, 142, 150, and 152 have been found to be operative to prevent the flow of fluid from reaching the heat transfer element plates 132. Accordingly, in addition a need has also been found to exist for a heat transfer element basket assembly in which less of the flow of fluid would be blocked by the structural members of the heat transfer element basket assembly.

OBJECTS OF THE INVENTION

It is an object of the present invention to provide a new and improved heat transfer element basket assembly, which is characterized by its structural integrity.

It is also an object of the present invention to provide such a new and improved heat transfer element basket assembly that is characterized by the fact that the material weight of the heat transfer element basket assembly has been reduced without any loss in structural integrity.

Another object of the present invention is to provide such a new and improved heat transfer element basket assembly that is characterized by its reversibility thereby providing for a maximum life span of the heat transfer element plates, which are supported in the heat transfer element basket assembly, by virtue of enabling the heat transfer element basket assembly to be reversed in its installed position within a rotary regenerative heat exchanger when such reversal of the heat transfer element basket assembly becomes desirable in order to enable both ends of the heat transfer element basket assembly to be exposed equally to the corrosive environment that is known to exist in a rotary regenerative heat exchanger.

Still another object of the present invention is to provide such a new and improved heat transfer element basket assembly wherein a one piece side strap is utilized thereby reducing the number of parts that the heat transfer element basket assembly requires and concomitantly therewith reducing as well the amount of welding that is required during the fabrication of the heat transfer element basket assembly.

Yet another object of the present invention is to provide such a new and improved heat transfer element basket assembly wherein the frontal area thereof has been increased by reducing the width of the plate supporting flange extensions thereof and concomitantly therewith the pressure drop across the heat transfer element basket assembly is reduced while at the same time the thermal performance of the heat transfer element plates, which are supported in the heat transfer element basket assembly, is improved.

The above-stated objects, as well as other objects, features, and advantages, of the present invention will become readily apparent from the following detailed description which is to be read in conjunction with the appended drawings.

SUMMARY OF THE INVENTION

In accordance with the present invention, a new and improved heat transfer element basket assembly for a heat exchanger, such as, but not limited to, a rotary regenerative heat exchanger, is provided. A stack of heat transfer element plates is suitably supported within the heat transfer element basket assembly of the present invention such that fluids are permitted to flow therebetween. The heat transfer element basket assembly, which can also be deemed to be a frame, has an inboard end, an outboard end, and first and second sides through which fluids and/or gases are capable of being made to flow. The inboard end and the outboard end of the heat transfer element basket assembly of the present invention are positioned so as to be located opposite to each other, while the first side and the second side are similarly suitably positioned so as to be also located opposite to one another. In addition, the heat transfer element basket assembly of the present invention also embodies third and fourth sides, which likewise are suitably positioned so as to be located opposite to one another. Preferably, though not necessarily, the inboard end of the heat transfer element basket assembly of the present invention is in accordance with the present invention made to be narrower than is the outboard end thereof.

The heat transfer element basket assembly of the present invention further includes first and second one-piece side straps that are spaced apart from one another. Each of the one-piece side straps has a center portion that is designed to be disposed along the inboard end of the heat transfer element basket assembly of the present invention. In addition, each of these one-piece side straps also includes first and second extensions that extend outward on each side of the center portion of the respective one of the one-piece side straps. To this end, the first extension of the first one-piece side strap is designed to be positioned along the third side of the heat transfer element basket assembly of the present invention and has a folded over portion that extends inwardly over the first side of the heat transfer element basket assembly of the present invention. This folded over portion is commonly referred to as a flange and is designed to be operative to keep the heat transfer element plates that are positioned within the heat transfer element basket assembly from falling out of the heat transfer element basket assembly of the present invention. The second extension of the first one-piece side strap is positioned along the fourth side of the heat transfer element basket assembly of the present invention and has a folded over portion that also extends inwardly over the first side of the heat transfer element basket assembly of the present invention. Thus, the first one-piece side strap is located in juxtaposed relation to the first side of the heat transfer element basket assembly of the present invention.

In a similar manner, the first extension of the second one-piece side strap is designed to be positioned along the third side of the heat transfer element basket assembly of the present invention and has a folded over portion that extends inwardly over the second side of the heat transfer element basket assembly of the present invention. The second extension of the second one-piece side strap is designed to be positioned along the fourth side of the heat transfer element basket assembly of the present invention and has a folded over portion that also extends inwardly over the second side of the heat transfer element basket assembly of the present invention. Thus, the second one-piece side strap is located in juxtaposed relation to the second side of the heat transfer element basket assembly of the present invention.

Continuing, the heat transfer element basket assembly constructed in accordance with the present invention also includes a pair of spaced corner flanges, which are designed to be operative to connect each of the one-piece side straps to one another. One of said pair of spaced corner flanges is located on the corner formed by the inboard end and the third side of the heat transfer element basket assembly of the present invention, while the other one of said pair of spaced corner flanges is located on the corner formed by the inboard end and the fourth side of the heat transfer element basket assembly of the present invention. The heat transfer element basket assembly constructed in accordance with the present invention also includes an I-shaped splitter plate. This I-shaped splitter plate is suitably located within the heat transfer element plates of the heat transfer element basket assembly of the present invention so as to be operative to effect therewith the interconnection of the aforementioned first one-piece strap with the aforementioned second one-piece strap.

In accordance with one aspect of the present invention, at the outboard end of the heat transfer element basket assembly of the present invention there is provided a cap to which the extensions to which reference has been made hereinbefore are connected. This cap in accordance with one embodiment thereof may take the form of an open cap, wherein this cap does not seal the outboard end of the heat transfer element basket assembly of the present invention. Whereas, in accordance with another embodiment thereof this cap may include a pair of spaced end straps and a pair of spaced corner flanges that differ from the pair of spaced corner flanges to which reference has been had hereinbefore, which are located at the inboard end of the heat transfer element basket assembly of the present invention.

In accordance with another aspect of the present invention, the heat transfer element basket assembly of the present invention does not include end plates. To this end, such end plates have heretofore typically been included in prior art forms of heat transfer element basket as a means of providing support therefor. However, due to the advantages that are capable of being derived from the heat transfer element basket assembly constructed in accordance with the present invention, the use of such end plates are not required therein.

In accordance with yet another aspect of the present invention, the I-shaped splitter plate employed in the heat transfer element basket assembly of the present invention includes a first end piece that is connected to a middle piece, which in turn is connected to a second end piece. This first end piece and this middle piece and this second end piece each are of the same width, and are suitably arranged relative to each other such that the middle piece is suitably positioned relative to the first end piece and the second end piece so as to extend perpendicularly both to the first end piece and to the second end piece. In accordance with a further modification of this aspect of the present invention, each of the first and second end pieces is provided with suitably arranged lifting slots. Because these lifting slots are symmetrical, either the first side or the second side of the heat transfer element basket assembly of the present invention may be oriented as the top of the heat transfer element basket assembly. To this end, the heat transfer element basket assembly of the present invention is thus reversible. With further reference thereto, the aforereferenced I-shaped splitter plate is designed so as to be connectable to the end of each of the four extensions, that is, to the first extension and to the second extension of the first one-piece side strap as well as to the first extension and to the second extension of the second one-piece side strap of the heat transfer element basket assembly of the present invention.

In accordance with still another aspect of the present invention, the first side and the second side of the heat transfer element basket assembly of the present invention are each suitably provided with at least one retaining bar that is designed to be operative for holding in the heat transfer element basket assembly of the present invention the heat transfer element plates that are positioned therewithin.

BRIEF DESCRIPTION OF THE DRAWINGS

In order to facilitate a fuller understanding of the present invention, reference is now made to the appended drawings. These drawings should not be construed as limiting the present invention, but are intended to be exemplary only.

DETAILED DESCRIPTION OF A PREFERRED EMBODIMENT

Figure 1:
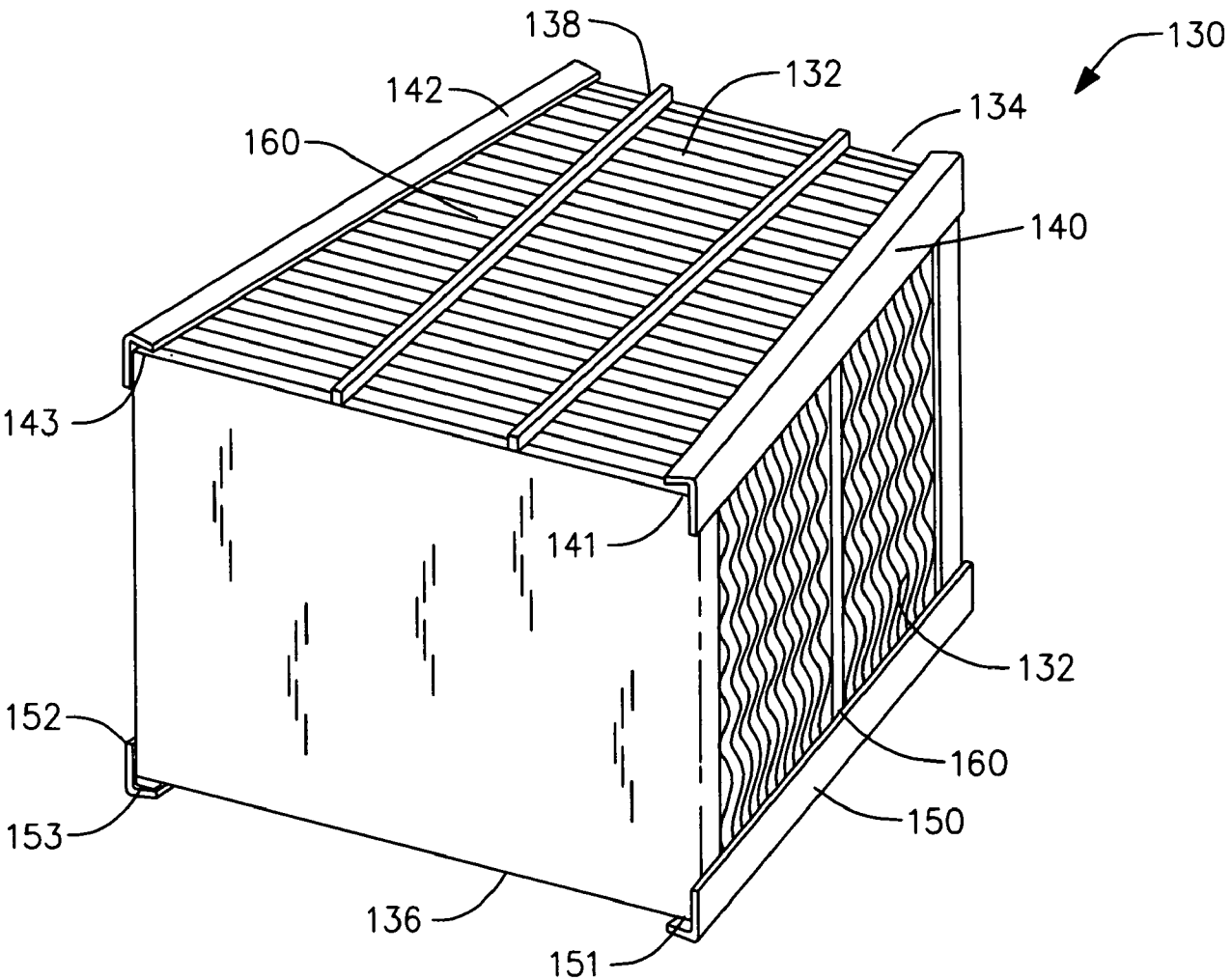
Figure 1 (Prior Art)
FIG. 1 is a perspective view of a prior art form of heat transfer element basket assembly.
Figure 2B:
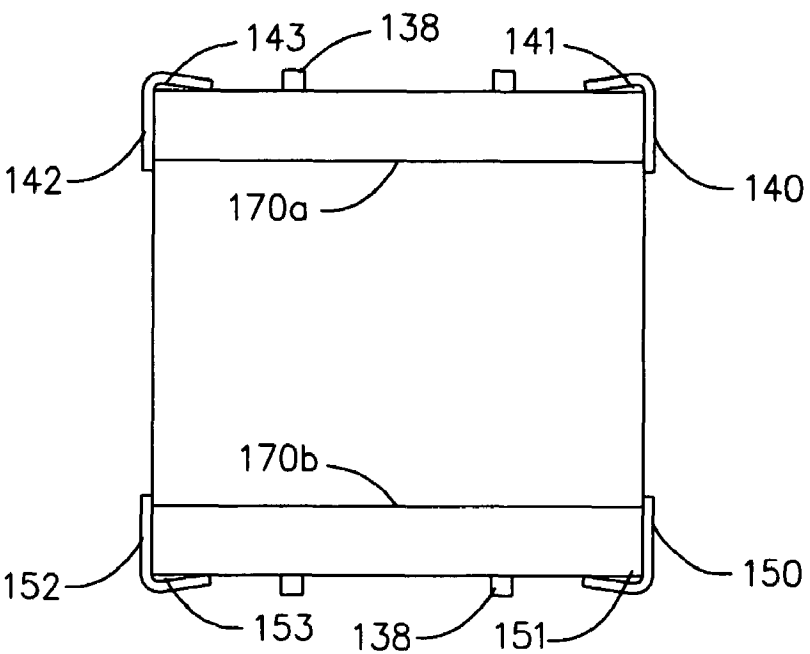
Figure 2b (Prior Art)
FIG. 2*b* is a second alternative cross-sectional elevational view of the prior art form of heat transfer element basket assembly of FIG. 1.
Figure 2A:
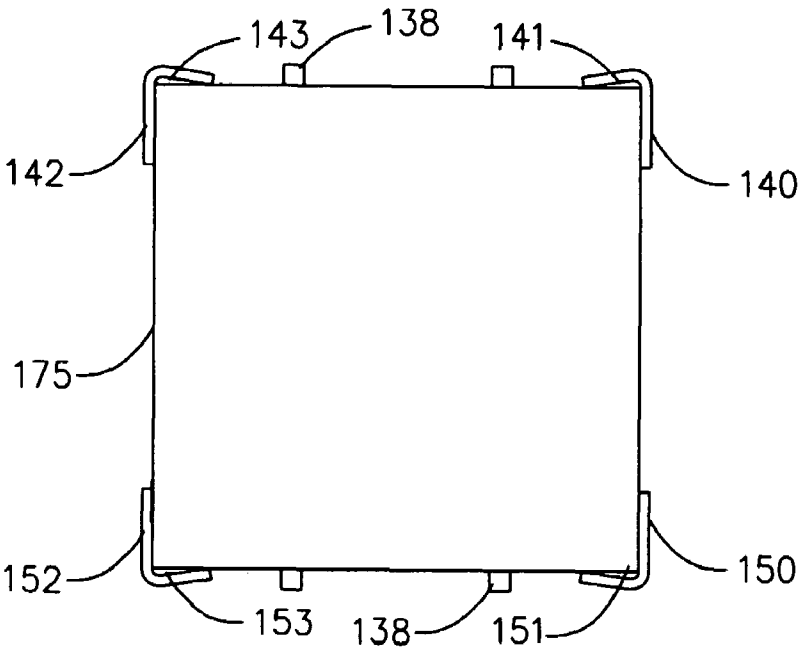
Figure 2a (Prior Art)
FIG. 2*a* is a first alternative cross-sectional elevational view of the prior art form of heat transfer element basket assembly of FIG. 1.
Figure 3:
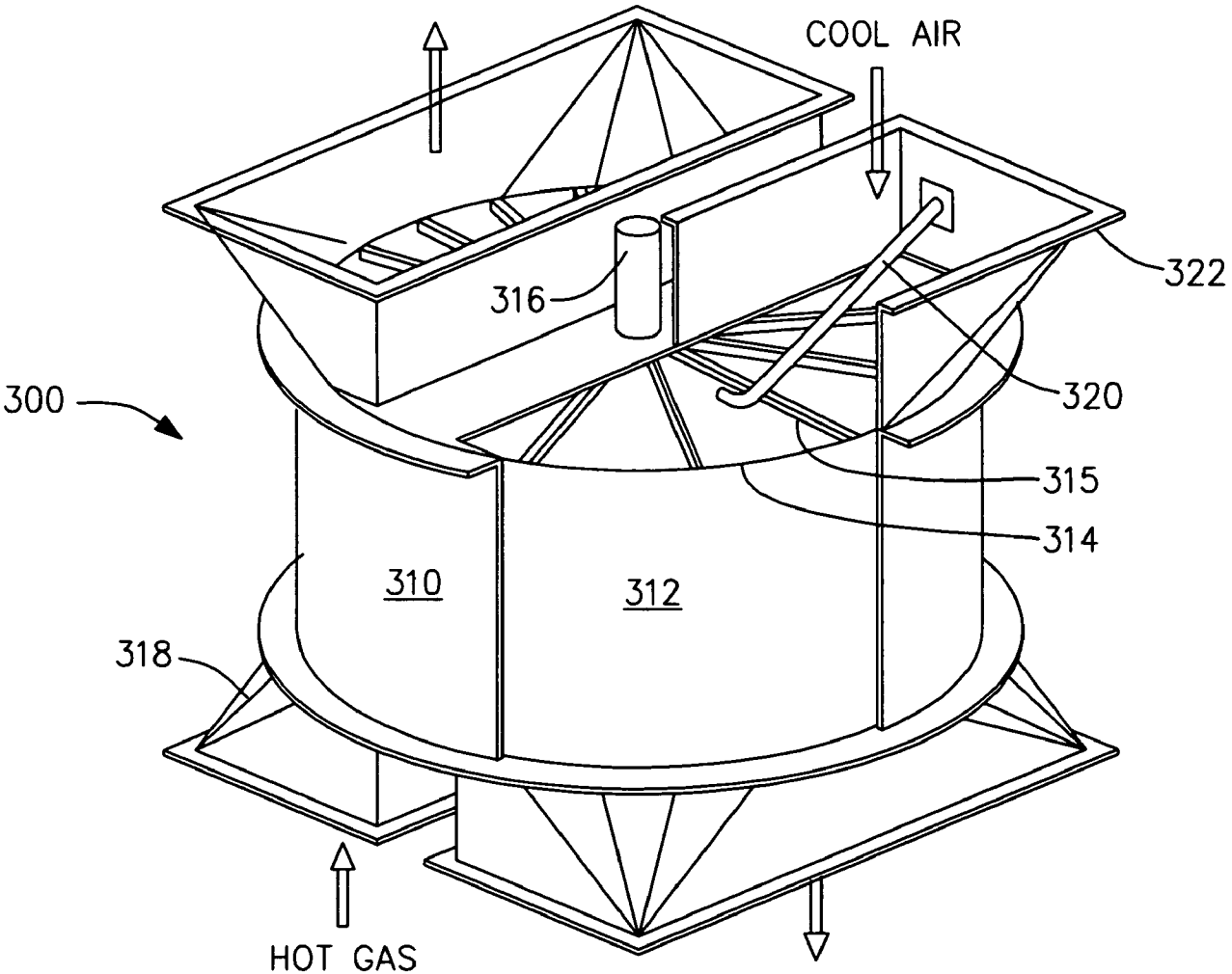
FIG. 3 is a perspective view of a rotary regenerative heat exchanger with which a heat transfer element basket assembly constructed in accordance with the present invention is capable of being employed.
Figure 4:
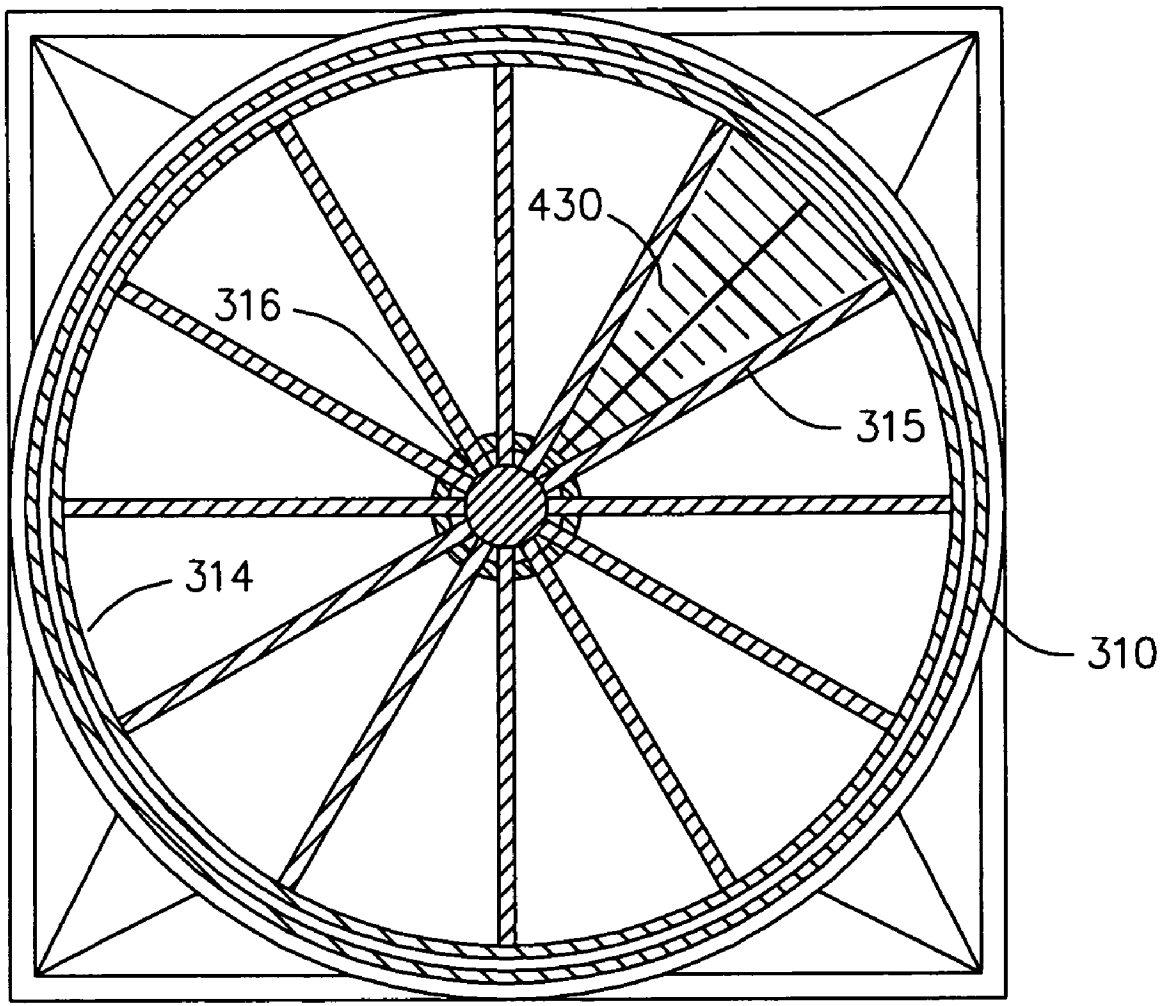
FIG. 4 is a plan view of the rotary regenerative heat exchanger of FIG. 3.

Referring to FIG. 3 of the drawings, there is depicted therein a rotary regenerative heat exchanger 300 in which a heat transfer element basket assembly constructed in accordance with the present invention is capable of being utilized. The heat transfer element basket assembly constructed in accordance with the present invention may also be deemed to constitute a heat transfer element basket frame. As illustrated in FIG. 3 of the drawings, the rotary regenerative heat exchanger 300 includes a housing 310 within which there is enclosed a rotor 312 in turn within which a heat transfer element basket assembly constructed in accordance with the present invention is designed to be suitably supported. The rotor 312 is in the form of a cylindrical shell 314, which is suitably connected, as best understood with reference to FIG. 3 of the drawings, by means of radially extending diaphragms 315 to a rotor post 316. A hot fluid is made to enter the housing 310 through the duct 318 whereas the fluid that is to be heated is made to enter the housing 310 from the opposite end thereof through the duct 322.

The rotor 312 is made to rotate about its axis in a manner well-known to those skilled in the art by means of a motor that is suitably connected to the rotor post 316 through conventional gearing that is suitable for use for such a purpose, which has not been illustrated in the interest of maintaining clarity of illustration in the drawings. As the rotor 312 rotates, the heat transfer element plates that are supported within the heat transfer element basket assemblies, which are suitably disposed within the rotor 312 for this purpose are first moved in contact with the hot fluid that enters the housing 310 through the duct 318 in order to thereby absorb heat from the hot fluid and are then made to move into contact with the fluid to be heated, which enters the housing 310 through the duct 322. As the hot fluid is made to flow over the heat transfer element plates, these heat transfer element plates absorb heat from the hot fluid. Then, as the fluid to be heated subsequently is made to flow over these heat transfer element plates, the fluid to be heated absorbs from the heat transfer element plates the heat, which the heat transfer element plates had absorbed from the hot fluid when the heat transfer element plates were in contact therewith.

The heat exchange material that is designed to be suitably provided in the rotor 312 is comprised of a stacked array preferably, in accordance with the present invention, of metallic heat transfer element plates that are provided with corrugations or undulations such that when these metallic heat transfer element plates are placed in abutting relationship with one another in such a stacked array, a series of internal passages are thereby created between the metallic heat transfer element plates and through which the hot fluid and cooling fluid are then capable of being made to flow. However, if so desired, other types of heat transfer element plates made of material other than metal or embodying a pattern other than corrugations or undulations may equally well be utilized without departing from the essence of the present invention. In accordance with the present invention said heat transfer element plates are suitably supported preferably in an essentially trapezoidal-shaped heat transfer element basket assembly.

Figure 5:
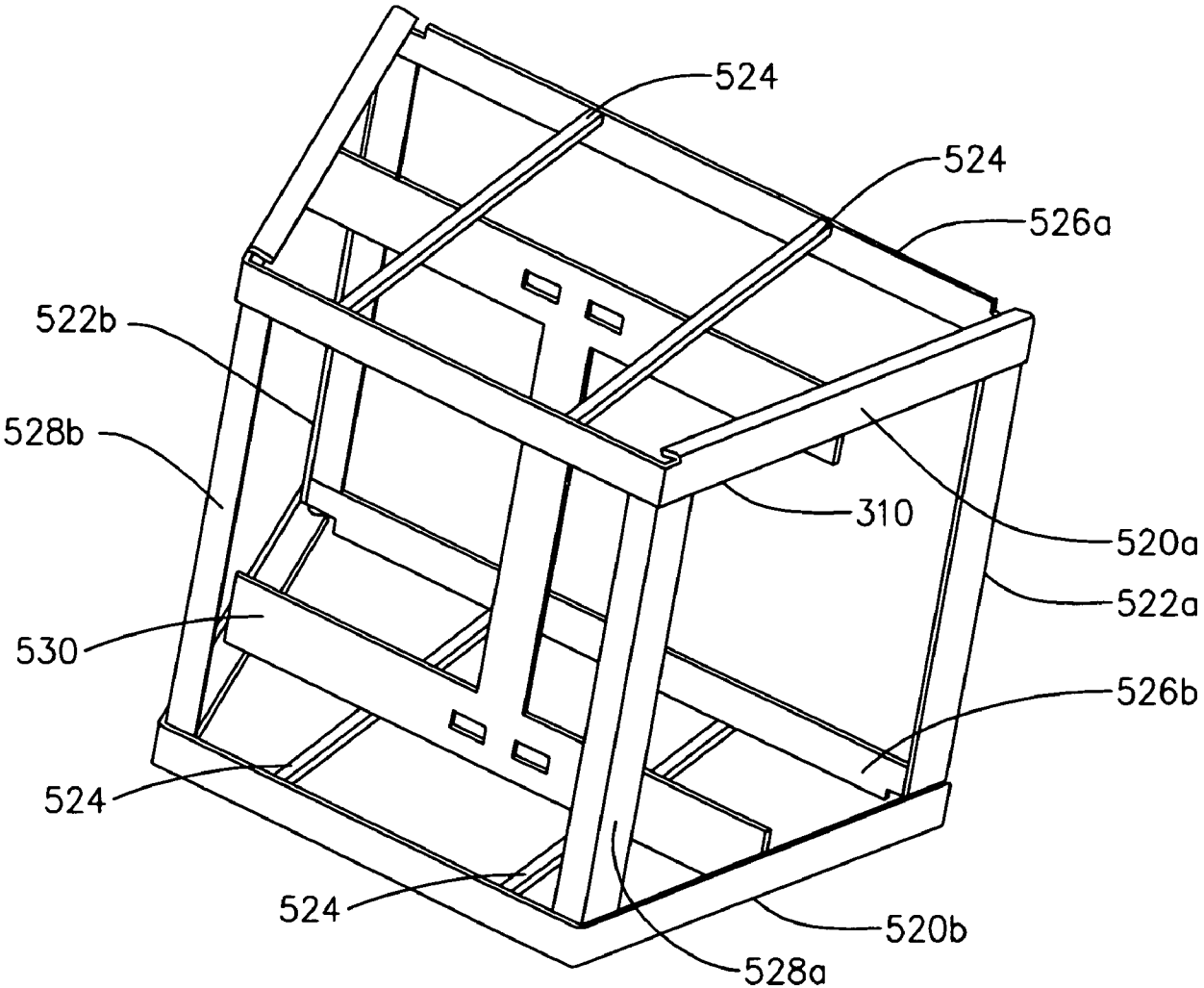
FIG. 5 is a first depiction of a heat transfer element basket assembly constructed in accordance with certain aspects of the present invention.

As illustrated in FIG. 5 of the drawings, in which in the interest of maintaining clarity of illustration in the drawings, the stacked array of heat transfer element plates are not depicted, the heat transfer element basket assembly 500 constructed in accordance with the present invention includes an improved stiffening member in the form of a splitter plate designated by the reference numeral 530. The splitter plate 530, which in accordance with the preferred embodiment of the present invention is preferably I-shaped, will be discussed in further detail hereinafter. The heat transfer element basket assembly 500, as best understood with reference to FIG. 5 of the drawings, also includes two identically formed one-piece side straps 520*a* and 520*b*, two identically formed inboard flange angles 528*a* and 528*b*, four retaining bars, each labeled with the same reference numeral 524, and an outboard cover, which may also be referred to as a cap. The outboard cover may either be open, i.e., be a bare frame, or else be closed, as one chooses, without departing from the essence of the present invention. With further reference thereto, the outboard cover is comprised of at least two identically formed outboard flange angles 522*a* and 522*b* and two identically notched end straps 526*a* and 526*b*. The inboard end of the heat transfer element basket assembly 500, in accordance with the preferred embodiment of the present invention embodies a narrower end such that, when the heat transfer element basket assembly 500 is suitably mounted within the rotor 312, said narrower inboard end of the heat transfer element basket assembly 500 lies closest to and in facing relation to the rotor post 316. The outboard end of the heat transfer element basket assembly 500, which is wider than the inboard end of the heat transfer element basket assembly 500 is suitably positioned so as to be opposite the inboard end of the heat transfer element basket assembly 500 when the heat transfer element basket assembly 500 is suitably mounted within the rotor 312. As should now be readily apparent, the heat transfer element basket assembly 500 differs from prior art forms of heat transfer element basket assemblies in that the heat transfer element basket assembly 500 constructed in accordance with the present invention is not provided with any end plates. As best understood with reference to FIG. 5 of the drawings, the heat transfer element basket assembly 500 in accordance with the present invention preferably is trapezoidal in shape and is provided with faces that are all open.

Figure 7:
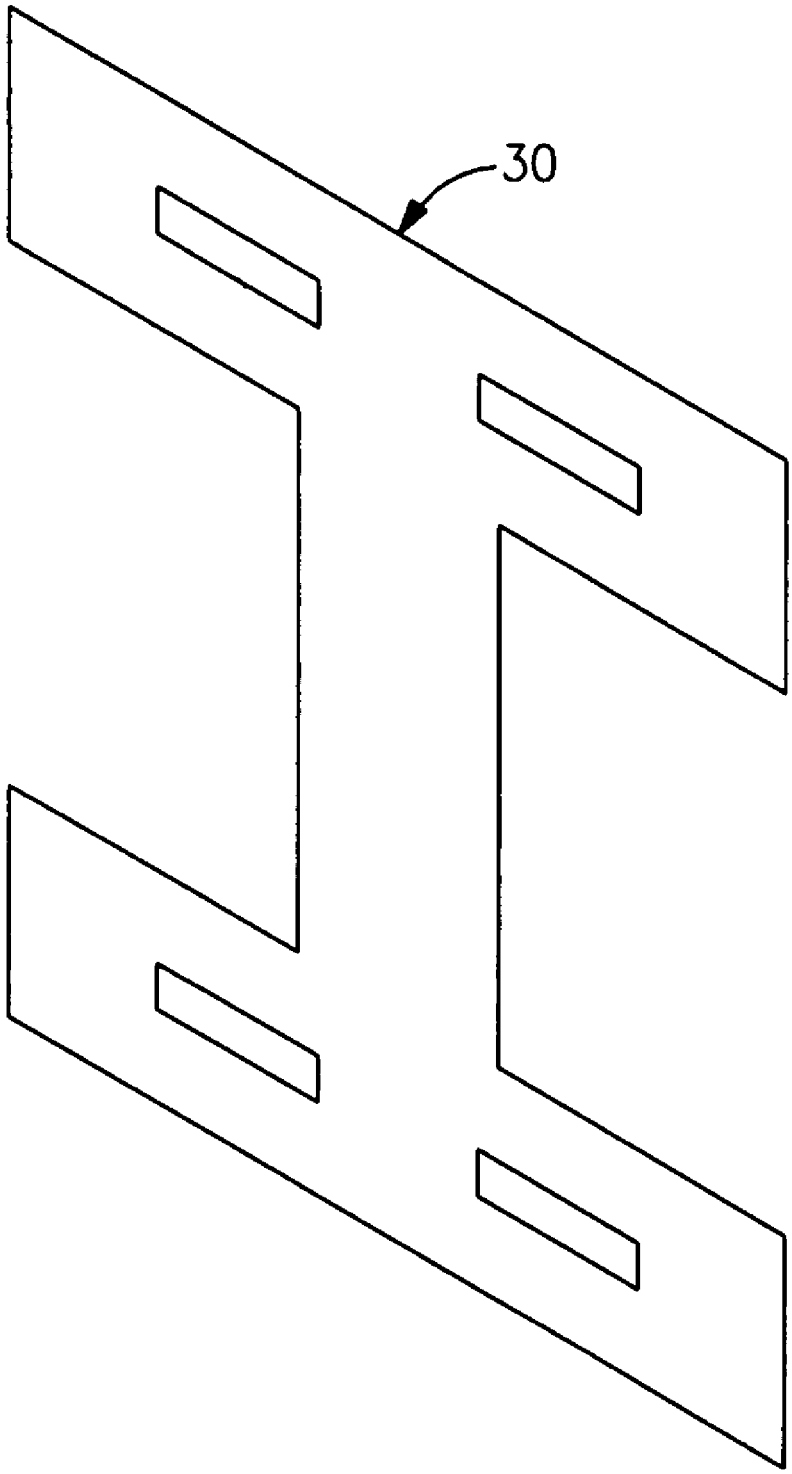
FIG. 7 depicts a splitter plate of the heat transfer element basket assembly of FIG. 5 constructed in accordance with certain aspects of the present invention.

The I-shaped splitter plate 530, as best understood with reference to FIG. 7 of the drawings, consists of three pieces of metal coil 710*a*, 710*b*, and 710*c*, each selected to be of equal width so as to thereby enable a reduction to be realized in the amount of scrap that is generated in the production thereof. To this end, that is, each of the pieces of metal coil 710*a*, 710*b*, and 710*c* thus needs only to be cut to length, and as such does not need to be trimmed for width. Continuing with the description thereof, piece 710*b* preferably is secured to each of the pieces 710*a* and 710*c* by means of a complete penetration butt weld, although, if so desired, other means suitable for purposes of effecting therewith the securing of the piece 710*b* to each of the pieces 710*a* and 710*c* may be employed for this purpose without departing from the essence of the present invention. Thus, as should now be readily apparent from a reference to FIG. 7 of the drawings, the splitter plate 530, as has been mentioned hereinbefore, in accordance with the preferred embodiment of the present invention is substantially I-shaped in configuration.

With further reference thereto, the end pieces 710*a* and 710*c*, as best understood with reference to FIG. 7 of the drawings, each have slots 720 formed therein. The slots 720 are provided for the purpose of enabling lifting hooks to be accepted therewithin in order to thereby enable the heat transfer element basket assembly 500 to be reversible, that is, to enable the heat transfer element basket assembly 500 to be liftable from either the end piece 710*a*, through the engagement of lifting hooks in the slots 720 that have been provided for this purpose in the end piece 710*a*, or the end piece 710*c*, through the engagement of lifting hooks in the slots 720 that have been provided for this purpose in the end piece 710*c*. Preferably, in accordance with the present invention the slots 720 are formed by means of their being punched out, although, if so desired, the slots 720 may be formed by any other means that is suitable for use for such a purpose without departing from the essence of the present invention.

As will be appreciated, the design of the splitter plate 530 enables a decrease to be realized in the material weight thereof without there being any concomitant loss in the structural integrity of the heat transfer element basket assembly 500. This in turn enables a reduction to be had in material cost as well as a reduction to be had in the time that is required in order to accomplish the assembly of the heat transfer element basket assembly 500, and also facilitates one's ability to handle the splitter plate 530. The reversibility afforded by the design of the splitter plate 530 enables the maximum life span of the heat transfer element plates, which are suitably supported in the heat transfer element basket assembly 500 to be thus realized as a result thereof. Further, by providing the lifting slots 720, which are suitably formed in both end pieces 710*a* and 710*c* of the splitter plate 530, the heat transfer element basket assembly 500 is capable of being lifted out of the rotary regenerative heat exchanger with which the heat transfer element basket assembly 500 constructed in accordance with the present invention is designed to be employed by using the method that is described and illustrated in U.S. Pat. No. 5,713,411 to Fierle, entitled "Means For Lifting Heat Transfer Element Baskets" and that is assigned to the same assignee as the present invention, and which is incorporated herein in its entirety.

In accordance with the method of construction of the heat transfer element basket assembly 500 of the present invention, all four pieces, that is, the outboard flange angles 522*a* and 522*b* and the notched end straps 526*a* and 526*b*, of the outboard cover and the three pieces of the splitter plate 530 are manufactured and assembled before the heat transfer element basket assembly 500 of the present invention is finally assembled. In accordance with the preferred embodiment of the present invention, the welding of the outboard cover and the welding of the splitter plate 530 is accomplished preferably through the use of an automated flux cored arc. As best understood with reference to FIG. 5 of the drawings the splitter plate 530 is designed to be located in the middle of the heat transfer element basket assembly 500 such that a first portion of the heat transfer element plates are positioned so as to lie between the splitter plate 530 and the outboard cover, and a second portion of the heat transfer element plates are positioned so as to lie between the splitter plate 530 and the two identically formed inboard flange angles 528*a* and 528*b*.

Figure 6A:
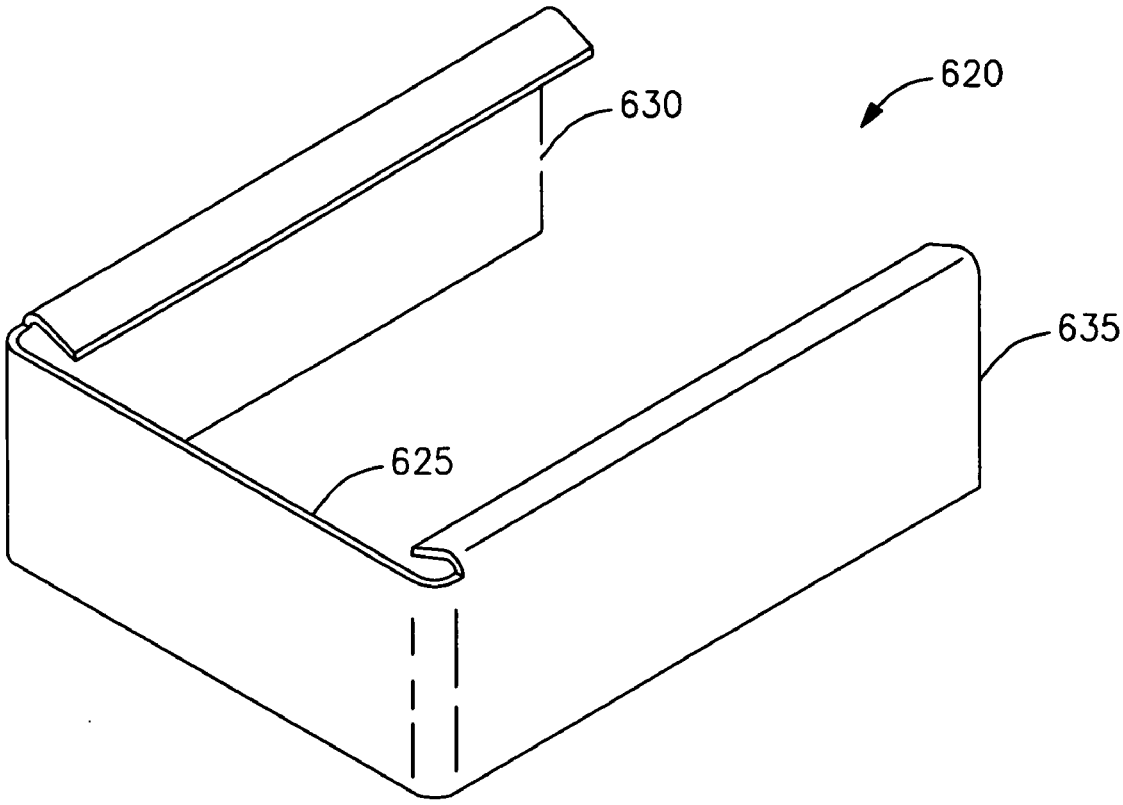
FIG. 6*a* is a first depiction of a side strap of the heat transfer element basket assembly of FIG. 5 constructed in accordance with certain aspects of the present invention.
Figure 6B:
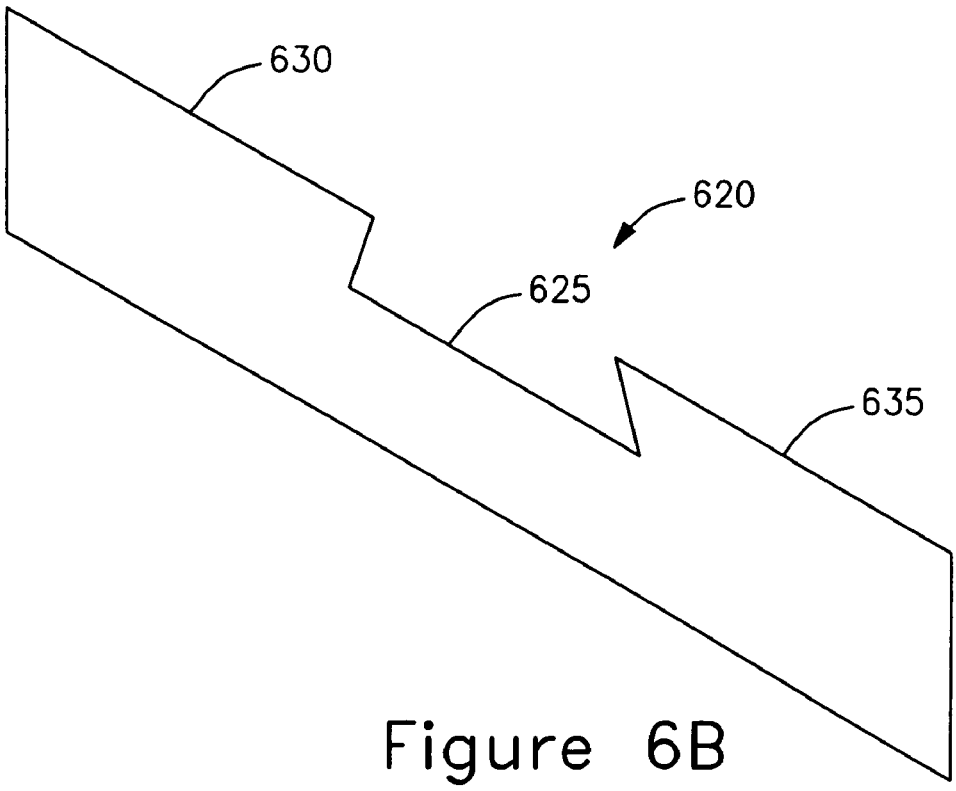
FIG. 6*b* is a second depiction of a side strap of the heat transfer element basket assembly of FIG. 5 constructed in accordance with certain aspects of the present invention.

There is depicted in each of FIGS. 6*a* and 6*b* of the drawings a one-piece side strap 520. More specifically, in FIG. 6*a* of the drawings there is illustrated a side strap 520, which has been bent to the extent necessary in order to thereby enable the integration thereof into the heat transfer element basket assembly 500, and in FIG. 6*b* of the drawings there is illustrated an unbent version of a side strap 520. Each of the one-piece side straps 520, as best understood with reference to FIGS. 6*a* and 6*b* of the drawings, includes a notch 620 that is suitably formed along the length of the center portion 625 of the one-piece side strap 520 so as to thereby be located between the extensions 630 and 635, respectively, of the one-piece side strap 520. The notch 620, in accordance with the present invention, is preferably formed by being punched out of the material from which the one-piece side strap 520 is fabricated. When the one-piece side strap 520 is installed in the heat transfer element basket assembly 500, the center portion 625 that has the notch 620 formed therein is suitably positioned across the inboard end of the heat transfer element basket assembly 500 such that each of the extensions 630, 635 of the one-piece side strap 520 are suitably positioned so as to lie along the length, that is, along a side, of the heat transfer element basket assembly 500 and so as to extend as far as the outboard end of the heat transfer element basket assembly 500. In accordance with the preferred embodiment of the present invention, the extensions 630 and 635 are preferably each folded inwardly to thereby form an inward flange that is designed to be operative for purposes of providing support for the heat transfer element plates that are emplaced in the heat transfer element basket assembly 500 such that these heat transfer element plates are prevented from falling out of the heat transfer element basket assembly 500.

The use of the one-piece formed side straps 520*a* and 520*b* enables a reduction to be realized in the time required for the assembly of the heat transfer element basket assembly 500 constructed in accordance with the present invention. More specifically, providing the uniquely shaped notch 620 enables the one-piece side strap 520 to be bent to conform with the shape of the heat transfer element basket assembly 500, as has been described previously hereinbefore, while concomitantly the center portion 625 extends beyond the heat transfer element plates, which are emplaced in the heat transfer element basket assembly 500 such as to thereby provide locations whereat retaining bars 524 may be welded. Each such retaining bar 524 is designed to abut the center portion 625 of a side strap 520 so as to thereby extend perpendicularly to such center portion 625 and so as to enable such retaining bar 524 to be welded completely thereto. Because the side straps 520*a* and 520*b* are identical to each other, this renders it possible for the retaining bars 524 to remain parallel to each other and for the retaining bars 524 to be welded completely thereto without any interference between with the retaining bars 524 and the inwardly extending flange of either one of the side straps 520*a* and 520*b*.

After the heat transfer element basket assembly 500 of the present invention has been assembled, the retaining bars 524 are located at the same elevation as that of the inwardly extending plate-supporting flanges of the extensions 630, 635 of the one-piece side straps 520. The extensions 630 and 635 of the one-piece side straps 520 are, in accordance with the preferred embodiment of the present invention, preferably made to be narrower in width than that of the width of the side straps, which have heretofore been employed in the prior art. By virtue of this an advantage that is to be derived therefrom is that it reduces the amount of fluid that is blocked from flowing between the heat transfer element plates, such blockage of fluid being something that has served to disadvantageously characterized prior art forms of heat transfer element basket assemblies. In addition, by virtue thereof this also enables the weight of the heat transfer element basket assembly 500 to be reduced as compared to the weight of prior art forms of heat transfer element basket assemblies, while concomitantly enabling the effectiveness of the heat transfer element basket assembly 500 constructed in accordance with the present invention to be increased as a result of the frontal element area thereof being increased. Furthermore, because the notch 620 is capable of being formed by being punched out of the material from which the one-piece side straps 520 are fabricated, it is thereby possible to manufacture these one-piece side straps 520 without creating during the manufacture thereof any scrap.

Each of the notched end straps 526*a*, 526*b* of the outboard cover in accordance with the present invention are intended to be welded to the two ends of a respective one of the side straps 520*a*, 520*b*. With further reference thereto, the notched end straps 526*a* and 526*b* in accordance with the preferred embodiment of the present invention are preferably made from a coil of material having the same thickness and width as that from which the one-piece side straps 520*a* and 520*b* are made. Preferably, though the notched end straps 526*a* and 526*b* embody a length that is longer than that of the respective center portion 625 of each of the side straps 520*a*, 520*b*. This in turn results in the heat transfer element basket assembly 500 being trapezoidal in shape. A further advantage that is derived from the use of a coil of material having the same thickness and width for purposes of making therefrom both the notched end straps 526*a* and 526*b* and the one-piece side straps 520*a* and 520*b* is that it thereby makes it possible to realize a more efficient manufacturing process by virtue of the fact that the need to effect changes in material are eliminated and by virtue of the fact that the manufacturing process becomes essentially a repetitive process. Continuing with a description thereof, also the notched end straps 526*a* and 526*b* are welded the retaining bars 524 such that in a manner similar to that of the side straps 520*a* and 520*b*, the description of which has been set forth herein previously, the retaining bars 524 are made to extend parallel to, and to abut, a respective one of the notched end straps 526*a*, 526*b*. Further to this point, it is thus possible to achieve a full weld between each such retaining bar 524 and each such one of the respective notched end straps 526*a*, 526*b*. Moreover, this weld does not interfere with the elevational positioning of the heat transfer element plates.

The outboard formed flange angles 522*a* and 522*b* are designed to be operative to provide a high degree of strength as well as a torsionally rigid corner support without any significant increase in the total weight of the heat transfer element basket assembly 500 constructed in accordance with the present invention. Similarly, the inboard formed flange angles 528*a* and 528*b* are likewise designed to be operative to provide a high degree of strength as well as a torsionally rigid corner support without any significant increase in the total weight of the heat transfer element basket assembly 500 constructed in accordance with the present invention. By virtue of both the outboard formed flange angles 522*a* and 522*b* and the inboard formed flange angles 528*a* and 528*b* all being symmetrical, each side of a corner of the heat transfer element basket assembly 500 is equally supported. Continuing, note is taken here of the fact that the inboard formed flange angles 522*a* and 522*b* are made to be of the same thickness as that of the side straps 520*a* and 520*b*. This enables the inboard formed flange angles 522*a* and 522*b* to become incorporated into the entire heat transfer element basket assembly 500 without sacrificing any of the spacing therein that desirably the heat transfer element plates should occupy. As a result thereof, it is thereby possible to realize therefrom a maximization of the effectiveness of the heat transfer element basket assembly 500 constructed in accordance with the present invention.

In a manner to which reference has briefly been had herein previously, at each inboard corner of the heat transfer element basket assembly 500 there is provided an inboard formed angle 528*a* and 528*b*, which is suitably connected to each of the two one-piece side straps 520*a* and 520*b*. With further reference thereto, the inboard formed angles 528*a* and 528*b*, like the outboard formed flange angles 522*a* and 522*b*, are designed so as to be symmetrical with each other.

As will be readily apparent to one of ordinary skill in the art, the improved design of the heat transfer element basket assembly 500 constructed in accordance with the present invention, including the employment therein of one-piece formed side straps 520 as well as the enhanced design of the splitter plate 530, renders it possible to reduce considerably the time that is required to effect the assembly of the heat transfer element basket assembly 500 of the present invention. Also, by eliminating the solid end plates that have heretofore commonly been employed in the prior art forms of heat transfer element basket assemblies, and by also decreasing the size of the side straps 520 and the size of the splitter plate 530, the total material costs for the heat transfer element basket assembly 500 constructed in accordance with the present invention are greatly reduced as compared to the material costs that are required in order to provide the prior art forms of heat transfer element basket assemblies.

Figure 8:
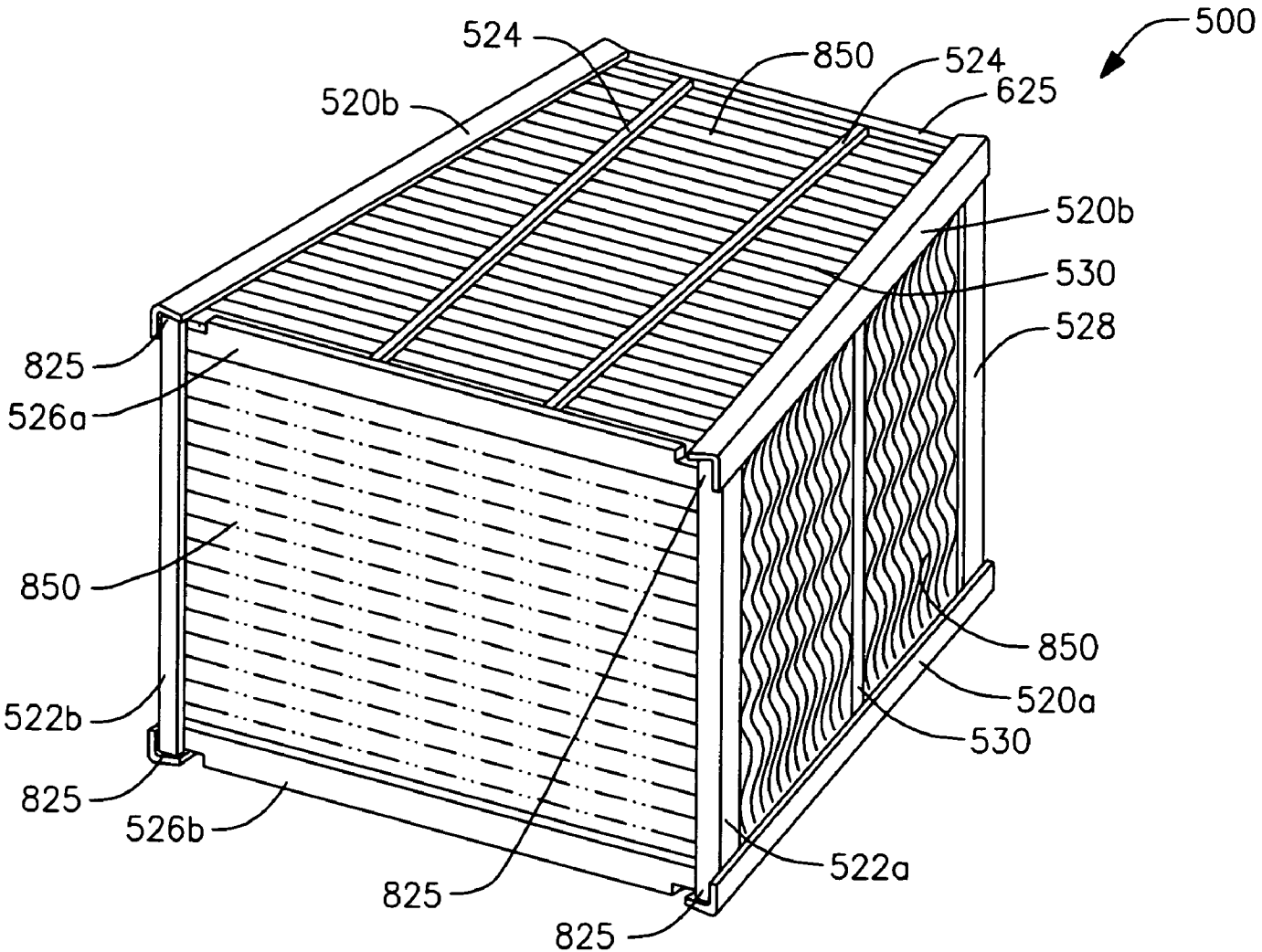
FIG. 8 is a second depiction of a heat transfer element basket assembly constructed in accordance with certain aspects of the present invention.

In FIG. 8 of the drawings, the heat transfer element basket assembly 500 is illustrated with heat transfer element plates 850 being suitably supported therein. To this end, FIG. 8 is a view looking from the outboard end of the heat transfer element basket assembly 500 to the inboard end thereof. Shown in FIG. 8 of the drawings, at the outboard end of the heat transfer element basket assembly 500 constructed in accordance with the present invention are the two outboard formed flange angles 522*a* and 522*b*, the two notched end straps 526*a* and 526*b*, and the ends of each of the one-piece side strap extensions, which are each identified therein by the same reference numeral 825. In accordance with the orientation of FIG. 8 of the drawings, the one-piece side strap 520*b* of the heat transfer element basket assembly 500 constructed in accordance with the present invention is depicted therein as being positioned on the top of the heat transfer element basket assembly 500, while the one-piece side strap 520*a* of the heat transfer element basket assembly 500 constructed in accordance with the present invention is depicted positioned on the bottom of the heat transfer element basket assembly 500. However, due to the reversibility of the heat transfer element basket assembly 500 constructed in accordance with the present invention, which has been discussed herein previously, the one-piece side strap 520*b* could equally well be positioned so as to be on the bottom of the heat transfer element basket assembly 500, and the one-piece side strap 520*a* could equally well be positioned so as to be on the top of the heat transfer element basket assembly 500 without departing from the essence of the present invention. With further reference to FIG. 8 of the drawings, two retaining bars, each identified by the same reference numeral 524, are depicted therein positioned so as to be in abutting relation to the center portion 625 of the side strap 520*b*. Also to be found illustrated in FIG. 8 of the drawings are an inboard formed flange angle 528 and the splitter plate 530.

The present invention is not to be limited in scope by the specific embodiments described herein. Indeed, various modifications of the present invention in addition to those described herein will be apparent to those of skill in the art from the foregoing description and accompanying drawings. Thus, such modifications are deemed to be within the scope of the appended claims.

What is claimed is:

1. A heat exchanger heat transfer element basket assembly for receiving a plurality of heat transfer element plates in supported relation therein and having an inboard end, an outboard end positioned so as to be located opposite to said inboard end, a first side through which fluid may flow, a second side through which fluid may flow that is positioned so as to be located opposite to said first side, a third side, and a fourth side positioned so as to be located opposite to said third side, said heat exchanger heat transfer element basket assembly comprising:

a first one-piece side strap having a center portion disposed along said inboard end of said heat exchanger heat transfer element basket assembly, a first extension disposed along said third side of said heat exchanger heat transfer element basket assembly and having a flange extending inwardly over said first side of said heat exchanger heat transfer element basket assembly operative to retain the plurality of heat transfer element plates when emplaced in said heat exchanger heat transfer element basket assembly, and a second extension disposed along said fourth side of said heat exchanger heat transfer element basket assembly and having a flange extending inwardly over said first side of said heat exchanger heat transfer element basket assembly operative to retain the plurality of heat transfer element plates when emplaced in said heat exchanger heat transfer element basket assembly;

a second one-piece side strap having a center position disposed along said inboard end of said heat exchanger heat transfer element basket assembly, a first extension disposed along said third side of said heat exchanger heat transfer element basket assembly and having a flange extending inwardly over said second side of said heat exchanger heat transfer element basket assembly operative to retain the plurality of heat transfer element plates when emplaced in said heat exchanger heat transfer element basket assembly, and a second extension disposed along said fourth side of said heat exchanger heat transfer element basket assembly and having a flange extending inwardly over said second side of said heat exchanger heat transfer element basket assembly operative to retain the plurality of heat transfer plates when emplaced in said heat exchanger heat transfer element basket assembly;

a pair of spaced corner flanges at said inboard end of said heat exchanger heat transfer element basket assembly connecting said first one-piece side strap of said heat exchanger heat transfer element basket assembly to said second one-piece side strap of said heat exchanger heat transfer element basket assembly; and an I-shaped splitter plate disposed within the plurality of heat transfer element plates emplaced within said heat exchanger heat transfer element basket assembly and interconnecting said first one-piece side strap of said heat exchanger heat transfer element basket assembly and said second one-piece side strap of said heat exchanger heat transfer element basket assembly with one another.

2. The heat exchanger heat transfer element basket assembly of claim 1 wherein end plates are excluded.

3. The heat exchanger heat transfer element basket assembly of claim 1 wherein the heat exchanger is a rotary regenerative heat exchanger.

4. The heat exchanger heat transfer element basket assembly of claim 1 wherein said inboard end of said heat exchanger heat transfer element basket assembly is narrower than said outboard end of said heat exchanger heat transfer element basket assembly.

5. The heat exchanger heat transfer element basket assembly of claim 1 wherein said I-shaped splitter plate includes a first end piece located adjacent to said first side of said heat exchanger heat transfer element basket assembly, a second end piece located adjacent to said second side of said heat exchanger heat transfer element basket assembly, and a middle piece connecting said first end piece of said I-shaped splitter plate with said second end piece of said I-shaped splitter plate, and said first end piece and said second end piece each being of the same width.

6. The heat exchange heat transfer element basket assembly of claim 5 wherein said first end piece of said I-shaped splitter plate and said second end piece of said I-shaped splitter plate each have lifting slots formed at two locations therein for use in effecting therewith the reversal of the positioning of said heat exchanger heat transfer element basket assembly.

7. The heat exchanger heat transfer element basket assembly of claim 1 wherein said I-shaped splitter plate interconnects said first extension of said first one-piece side strap of said heat exchanger heat transfer element basket assembly, said second extension of said first one-piece side strap of said heat exchanger heat transfer element basket assembly, said first extension of said second one-piece side strap of said heat exchanger heat transfer element basket assembly, and said second extension of said second one-piece side strap of said heat exchanger heat transfer element basket assembly.

8. The heat exchanger heat transfer element basket assembly of claim 1 further comprising:

at least one retaining bar located along said first side of said heat exchanger heat transfer element basket assembly; and at least one retaining bar located along said second side of said heat exchanger heat transfer element basket assembly.

9. The heat exchanger heat transfer element basket assembly of claim 1 further comprising a cap located at said outboard end of said heat exchanger heat transfer element basket assembly interconnecting the ends of each of said first extension of said first one-piece side strap, said second extension of said first one-piece side strap, said first extension of said second one-piece side strap and said second extension of said second one-piece side strap of said heat exchanger heat transfer element basket assembly.

10. The heat exchanger heat transfer element basket assembly of claim 9 wherein said cap is an open cap.

11. The heat exchanger heat transfer element basket assembly of claim 9 wherein:

said pair of spaced corner flanges comprises a first pair of spaced corner flanges; and said cap includes a pair of spaced end straps and a second pair of spaced corner flanges.

12. A heat exchanger heat transfer element basket assembly for receiving a plurality of heat transfer element plates in supported relation therein and having an inboard end, an outboard end positioned so as to be located opposite to said inboard end, a first side through which fluid may flow, a second side through which fluid may flow that is positioned so as to be located opposite to said first side, a third side, and a fourth side positioned so as to be located opposite to said third side, said heat exchanger heat transfer element basket comprising:

a pair of spaced apart one-piece side straps each located so as to be positioned along said third side, said inboard end, and said fourth side of said heat exchanger heat transfer element basket assembly;

a pair of spaced apart corner flanges located so as to be positioned at said inboard end of said heat exchanger hear transfer element basket assembly connecting said pair of one-piece side straps of said heat exchanger heat transfer element basket assembly; and an I-shaped splitter plate having a first end piece positioned so as to be located adjacent to said first side of said heat exchanger heat transfer element basket assembly, a second end piece positioned so as to be located adjacent to said second side of said heat exchanger heat transfer element basket assembly, and a middle piece connecting said first end piece and said second end piece of said I-shaped splitter plate, said I-shaped splitter plate being disposed within the plurality of heat transfer element plates emplaced within said heat exchanger heat transfer element basket assembly and interconnecting said pair of one-piece side straps of said heat exchanger heat transfer element basket assembly.

13. The heat exchanger heat transfer element basket assembly of claim 12 wherein:

said pair of spaced apart one-piece side straps of said heat exchanger heat transfer element basket assembly includes a first one-piece side strap and a second one-piece side strap;

said first one-piece side strap has a center portion disposed along said inboard end of said heat exchanger heat transfer element basket assembly, a first extension disposed along said third side of said heat exchanger heat transfer element basket assembly and having a flange extending inwardly over said first side of said heat exchanger heat transfer element basket assembly operative to retain the plurality of heat transfer element plates when emplaced in said heat exchanger heat transfer element basket assembly, and a second extension disposed along said fourth side of said heat exchanger heat transfer element basket assembly and having a flange extending inwardly over said first side of said heat exchanger heat transfer element basket assembly operative to retain the plurality of heat transfer element plates when emplaced in said heat exchanger heat transfer element basket assembly; and said second one-piece side strap has a center position disposed along said inboard end of said heat exchanger heat transfer element basket assembly, a first extension disposed along said third side of said heat exchanger heat transfer element basket assembly and having a flange extending inwardly over said second side of said heat exchanger heat transfer element basket assembly operative to retain the plurality of heat transfer element plates when emplaced in said heat exchanger heat transfer element basket assembly, and a second extension disposed along said fourth side of said heat exchanger heat transfer element basket assembly and having a flange extending inwardly over said second side of said heat exchanger heat transfer element basket assembly operative to retain the plurality of heat transfer element plates when emplaced in said heat exchanger heat transfer element basket assembly.

14. The heat exchanger heat transfer element basket assembly of claim 13 wherein said I-shaped splitter plate interconnects said first extension of said first one-piece side strap of said heat exchanger heat transfer element basket assembly, said second extension of said first one-piece side strap of said heat exchanger heat transfer element basket assembly, said first extension of said second one-piece side strap of said heat exchanger heat transfer element basket assembly, and said second extension of said second one-piece side strap of said heat exchanger heat transfer element basket assembly.

15. The heat exchanger heat transfer element basket assembly of claim 14 further comprising a cap located at said outboard end of said heat exchanger heat transfer element basket assembly interconnecting the ends of each of said first extension of said first one-piece side strap, said second extension of said first one-piece side strap, said first extension of said second one-piece side strap and said second extension of said second one-piece side strap of said heat exchanger heat transfer element basket assembly.

16. The heat exchanger heat transfer element basket assembly of claim 14 wherein:

said pair of spaced corner flanges comprises a first pair of spaced corner flanges; and said cap is an open cap having a pair of spaced end straps and a second pair of spaced corner flanges.

17. The heat exchanger heat transfer element basket assembly of claim 12 wherein said first end piece of said I-shaped splitter plate and said second end piece of said I-shaped splitter plate each have lifting slots formed at two locations therein for use in effecting therewith the reversal of the positioning of said heat exchanger heat transfer element basket assembly.

18. The heat exchanger heat transfer element basket assembly of claim 12 further comprising:

at least one retaining bar located along said first side of said heat exchanger heat transfer element basket assembly; and at least one retaining bar located along said second side of said heat exchanger heat transfer element basket assembly.

19. The heat exchanger heat transfer element basket assembly of claim 12 wherein end plates are excluded.

* * * * *